US006685513B2

(12) United States Patent
Bienvenu

(10) Patent No.: US 6,685,513 B2
(45) Date of Patent: Feb. 3, 2004

(54) ELASTIC ELECTRICAL CONTACT WITH AXIAL PRESSURE, COMPRISING ADJUSTABLE CONNECTION TERMINAL

(75) Inventor: Didier Bienvenu, Champigny-sur-Marne (FR)

(73) Assignee: Société d'Exploitation des Procédés Maréchal-(SEPM), Saint-Maurice Cedex (FR)

( * ) Notice: Subject to any disclaimer, the term of this patent is extended or adjusted under 35 U.S.C. 154(b) by 0 days.

(21) Appl. No.: 10/049,614

(22) PCT Filed: Jun. 21, 2001

(86) PCT No.: PCT/FR01/01949

§ 371 (c)(1),
(2), (4) Date: Mar. 25, 2002

(87) PCT Pub. No.: WO01/99234

PCT Pub. Date: Dec. 27, 2001

(65) Prior Publication Data

US 2002/0134571 A1 Sep. 26, 2002

(30) Foreign Application Priority Data

Jun. 22, 2000 (FR) ..... 00 08004

(51) Int. Cl.[7] ..... H01R 13/24
(52) U.S. Cl. ..... 439/700; 439/447; 439/275
(58) Field of Search ..... 439/274, 275, 439/447, 587, 700, 145, 137

(56) References Cited

U.S. PATENT DOCUMENTS

| | | | |
|---|---|---|---|
| 1,995,172 | A | 3/1935 | Douglas |
| 3,296,361 | A | 1/1967 | Markland |
| 3,549,780 | A | 12/1970 | Graneau et al. |
| 4,176,905 | A | 12/1979 | Marechal |
| 4,743,201 | A | 5/1988 | Robinson et al. |
| 5,131,870 | A | 7/1992 | El-Haj |
| 5,879,198 | A | 3/1999 | Sekimori et al. |
| 6,275,054 | B1 | 8/2001 | Boyle |
| 6,479,773 | B2 | 11/2002 | Bienvenu |

FOREIGN PATENT DOCUMENTS

| | | |
|---|---|---|
| DE | 9412635 | 12/1994 |
| DE | 19900201 | 5/2000 |
| FR | 1398945 | 4/1964 |
| FR | 2545993 | 11/1984 |
| FR | 2709025 | 2/1995 |
| FR | 2768897 | 3/1999 |

*Primary Examiner*—Khiem Nguyen
(74) *Attorney, Agent, or Firm*—Greenblum & Bernstein, P.L.C.

(57) ABSTRACT

An elastic electrical contact housed in a guide shaft of an apparatus, wherein the guide shaft includes an open front end and an opened back end, and wherein the contact includes a deformable conductor having a front portion and a flexible back portion. A mobile contact head is arranged in an area of the open front end of the guide shaft. A coil spring surrounds the front portion of the deformable conductor. The coil spring extends between the mobile contact head and a retaining sleeve. The retaining sleeve is arranged in an area of the open back end of the guide shaft. The retaining sleeve is fixed to the deformable conductor. The flexible back portion of the deformable conductor extends outwardly from the open back end of the guide shaft. The mobile contact head is connected to a connection terminal of a supply cable via the back portion of the deformable conductor.

24 Claims, 1 Drawing Sheet

ELASTIC ELECTRICAL CONTACT WITH AXIAL PRESSURE, COMPRISING ADJUSTABLE CONNECTION TERMINAL

CROSS-REFERENCE TO RELATED APPLICATIONS

The present application is a National Stage Application of International Application No. PCT/FR01/01949, filed Jun. 21, 2001. Further, the present application claims priority under 35 U.S.C. §119 of French Patent Application No. 00/08004 filed on Jun. 22, 2000.

BACKGROUND OF THE INVENTION

1. Field of the Invention

The invention relates to an elastic electrical contact with axial pressure comprising an adjustable connection terminal.

2. Description of Background and Relevant Information

Elastic electrical contacts with axial pressure are well known and frequently used to equip electrical outlets or a movable connection plug.

The contact head is designed to come into elastic contact, under the action of a coil spring with an antagonistic contact, which may be rigid or elastic, provided in a plug or a connector base. The aforementioned coil spring, which is housed in a guide shaft and operates by compression, encloses the deformable conductor and leans at each of its ends respectively on a bearing surface of the connection terminal and a bearing surface of the contact head.

Known electric contacts of this type use as deformable conductor a metal braid which can be deformed by crushing.

In this type of contact, the supply cable is generally rigid or semi-rigid and connected to the connection terminal. It is often difficult to house it in an apparatus whose shape must obviously be optimised for its function and not for the installation of the cable, especially when the supply cable is rigid and not coaxial with the contact.

That is why the inventor tried to design a contact comprising an adjustable connection terminal.

SUMMARY OF THE INVENTION

To this effect, the invention proposes an electric contact with axial pressure designed to be housed in a guide shaft open at both ends, provided in an apparatus to be equipped, and comprising a mobile contact head connected to a connection terminal of a supply cable by a deformable conductor, the contact head being stressed by a coil spring operating by compression which encloses said deformable conductor and is supported at each of its ends respectively on the contact head and a retaining element which is housed in the base of the guide shaft and fixed to the deformable conductor, said contact being characterized in that the retaining element is a sleeve which is fixed to the deformable conductor and traversed by an extension of said deformable conductor at the end of which is provided the terminal for connection to the electric supply cable, so that said terminal is adjustable owing to the flexibility of the deformable conductor.

It is clear that such a device facilitates cabling which, additionally, can be achieved without requiring much space.

Such an arrangement does not cause any additional contact resistance and thus no further heating. The contacts can be prepared and arranged in advance in the apparatus, then connected by means of standard tools, According to a form of embodiment, the sleeve fixed to the deformable conductor is retained in the guide shaft by at least one washer which leans against the base of the guide shaft or an intermediate piece.

To improve tightness in connecting the supply cable to the guide shaft, the invention provides a particular form of embodiment in which at least one tubular seal is clamped on the base of the guide shaft, traverses said base, and encloses the extension of the deformable conductor and the connection terminal and grips the extension sheath of the supply cable. Together with an adjustable connection terminal, this arrangement ensures tightness and electrical isolation between various contacts.

For example, the seal has an annular lip which is provided between the sleeve or a part connected to it, and the base of the guide shaft, in such a manner that an axial pressure of the coil spring is exerted on said lip. In case the sleeve is provided with at last one washer as mentioned above, the lip of the seal is then gripped between said washer and the base of the guide shaft.

To make tightness complete the contact head can also be provided with a toric seal.

As previously mentioned, the deformable conductor, which may be of any type, is usually in the form of a braid which can be deformed by crushing.

The invention also provides for an elastic electrical contact housed in a guide shaft of an apparatus, wherein the guide shaft includes an open front end and an opened back end, the contact comprising a deformable conductor having a front portion and a flexible back portion. A mobile contact head is arranged in an area of the open front end of the guide shaft. A coil spring surrounds the front portion of the deformable conductor. The coil spring extends between the mobile contact head and a retaining sleeve. The retaining sleeve is arranged in an area of the open back end of the guide shaft. The retaining sleeve is fixed to the deformable conductor. The flexible back portion of the deformable conductor extends outwardly from the open back end of the guide shaft. The flexible back portion of the deformable conductor is connected to a connection terminal of a supply cable. The mobile contact head is connected to the connection terminal of the supply cable via the back portion of the deformable conductor.

The retaining sleeve may be retained in the guide shaft via at least one washer. The at least one washer may engage the retaining sleeve. The at least one washer may engage a shoulder of the guide shaft. The electrical contact may further comprise a tubular seal having one end that is clamped to the open back end of the guide shaft. The tubular seal may enclose the connection terminal and the back portion of the deformable conductor. The tubular seal may enclose a portion of the supply cable. The tubular seal may comprise an annular lip that is arranged between a retaining sleeve and a shoulder of the guide shaft. The coil spring may be configured to exert axial pressure on the annular lip. The electrical contact may further comprise a toric seal arranged on the mobile contact head. The electrical contact may further comprise a toric seal arranged to provide sealing between the mobile contact head and the guide shaft. The deformable conductor may comprise a braid. The braid may be configured to deform by crushing. The retaining sleeve may be retained in the guide shaft via at least one washer wherein the at least one washer engages an intermediate member.

The invention may provide for a connection system comprising a connection apparatus including a contact housing having an open front end and an open back end. A contact comprises a contact head, a coil spring, a retaining sleeve and a deformable conductor. The contact head is arranged in an area of the open front end of the contact housing. The deformable conductor has a front portion connected to the contact head and a flexible back portion that extends outside the contact housing. A coil spring is arranged in the contact housing and surrounds the front portion of the deformable conductor. The coil spring extends between the contact head and the retaining sleeve. The retaining sleeve is arranged in an area of the open back end of the contact housing. The retaining sleeve is fixed to the deformable conductor. The contact head is connected to a connection terminal of a supply cable outside of the contact housing via the flexible back portion of the deformable conductor.

The retaining sleeve may be retained in the contact housing via at least one washer. The at least one washer may engage a shoulder of the contact housing. The electrical contact may further comprise a tubular seal having one end that is clamped to the open back end of the contact housing. The tubular seal may enclose the connection terminal, the back portion of the deformable conductor and a portion of the supply cable. The tubular seal may comprise an annular lip that is arranged between a retaining sleeve and a shoulder of the contact housing. The electrical contact may further comprise a seal arranged to provide sealing between the contact head and the contact housing. The deformable conductor may comprise a braid.

The invention also provides for a connection system comprising a connection apparatus including a contact housing having an open front end and an open back end. A contact comprises a contact head, a coil spring, a retaining sleeve and a braid conductor. The contact head is arranged in an area of the open front end of the contact housing. The braid conductor comprises a front portion coupled to the contact head and a flexible back portion that extends outside the contact housing. A coil spring is arranged in the contact housing and surrounds a portion of the braid conductor. The coil spring extends between the contact head and the retaining sleeve. The retaining sleeve is arranged in an area of the open back end of the contact housing. The retaining sleeve is fixed to the braid conductor. The flexible back portion of the braid conductor is connected to a connection terminal of a supply cable.

The retaining sleeve may be retained in the contact housing via at least one washer. The at least one washer may engage a shoulder of the contact housing and the system may further comprise a tubular seal having one end that is clamped to the open back end of the contact housing.

BRIEF DESCRIPTION OF THE DRAWINGS

The invention will be more readily understood from the description below and the only accompanying drawing (FIG. 1) which is a sectional view of a part of a removable hold of a connector provided with at least one contact according to the invention.

The FIGURE shows part of an apparatus to be equipped A, which in this case, is a removable hold of a connector provided with at least one contact according to the invention.

DETAILED DESCRIPTION OF THE INVENTION

Figure 1:
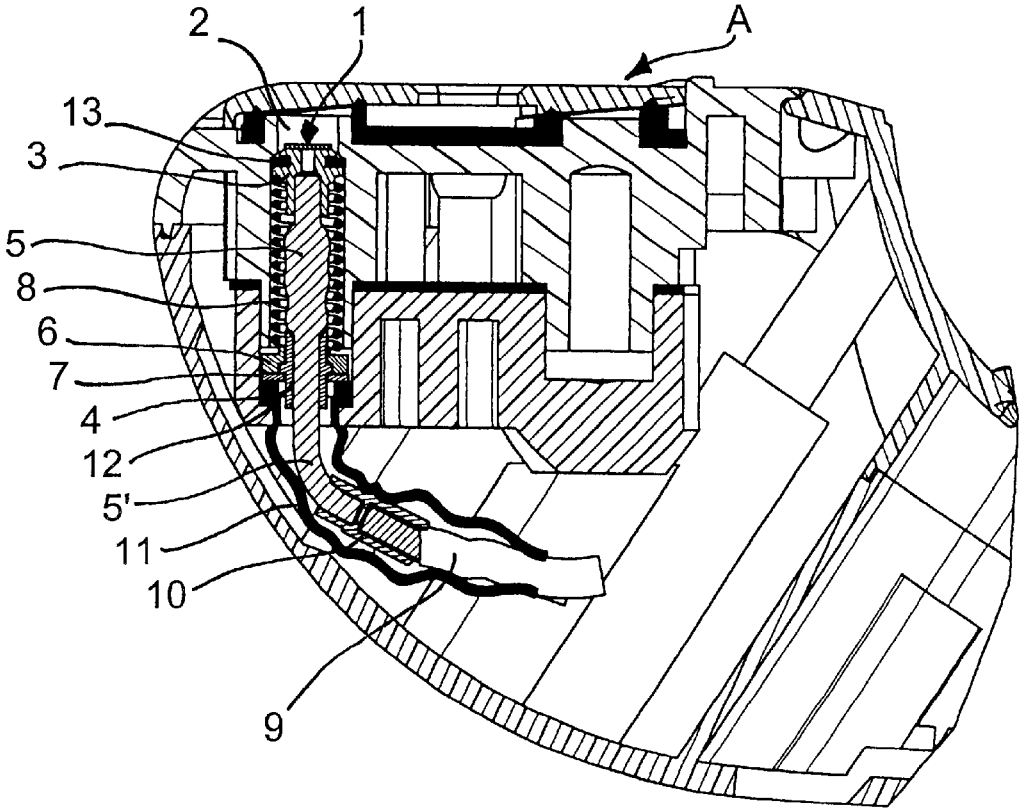

The removable hold shown is obviously given as an example and it can be an electrical outlet.

The contact 1 is provided in an insulating place or guide shaft 2, also called contact support, provided in the apparatus A, said guide shaft being open at both ends.

The contact 1 has a contact head 3 which is movably and longitudinally mounted in the guide shaft 2. As shown in the drawings, the contact head is retained in the guide shaft 2 by a choke in the latter and electrically connected to a retaining element 4 (FIG. 1), provided in the base of the guide shaft 2 by a deformable conductive braid 5 which can be deformed by crushing.

The retaining element has also two washers 6, 7, the upper washer 6 being slit for mounting and production.

A coil spring 8 operating by compression is placed around the braid 5 between a bearing surface of the contact head 3 and the upper washer 6 of the retaining element 4.

In that way, it can be seen that the spring 8 retains the contact head 3 in the position shown, namely towards the orifice corresponding to the guide shaft 2, said contact head being provided as mentioned earlier to come into elastic contact with an antagonistic contact (not shown) under the action of the spring 8.

Such a contact is naturally designed to be connected to an electrical supply cable placed in the apparatus such as the cable 9 shown in the figure.

In a known manner the retaining element has a terminal for connection to the cable 9, in the form of embodiment of the invention, to render the terminal adjustable, said retaining element 4 is a sleeve crimped or soldered on the braid 5, and said braid has an extension 5' which traverses said sleeve 4 and emerges from the guide shaft 2 while the end of the extension 5' of the braid is provided with a terminal 10 for connection to the cable 9 in such a manner that said terminal 10 is adjustable as the braid is flexible.

The connection terminal is provided with any suitable arrangement to ensure connection, such as a clamping screw, unless connection is achieved by crimping or soldering.

In order to seal or isolate the contact terminal and the extension of the braid, the invention provides a flexible tubular seal 11 with a lip 12.

The lip 12 is placed between the lower washer 7 of the retaining element 4 and the base of the guide shaft 2.

The seal 11 partially encloses the retaining element 4 as well as the extension 5' of the braid 5 and the connection terminal 10, and grips the externa sheath of the supply cable 9.

Naturally the lip 12 of the seal 11 is compressed by the action of the spring and thus assures aimed tightness.

To complete tightness the contact head 3 has also a toric seal 13 as shown in the drawings.

The seal 11 comprises, for example, a single piece of rubber which can advantageously be curled up to facilitate connection, but it may also have several parts of different types.

Tightness between the insulating material in which the guide shaft is provided and the external sheath of the cable 9 is thus achieved.

As mentioned earlier, the seal ensures not only tightness, but also electrical insulation from adjacent contacts.

What is claimed is:

1. An elastic electrical contact housed in a guide shaft of an apparatus, wherein the guide shaft includes an open front end and an open back end, the contact comprising:

a deformable conductor having a front portion and a flexible back portion;

a mobile contact head being arranged in an area of the open front end of the guide shaft;

a coil spring surrounding the front portion of the deformable conductor;

the coil spring extending between the mobile contact head and a retaining sleeve;

the retaining sleeve being arranged in an area of the open back end of the guide shaft;

the retaining sleeve being fixed to the deformable conductor;

the flexible back portion of the deformable conductor extending outwardly from the open back end of the guide shaft; and the flexible back portion of the deformable conductor being connected to a connection terminal of a supply cable, wherein the mobile contact head is connected to the connection terminal of the supply cable via the back portion of the deformable conductor.

2. The electrical contact of claim 1, wherein the retaining sleeve is retained in the guide shaft via at least one washer.

3. The electrical contact of claim 2, wherein the at least one washer engages the retaining sleeve.

4. The electrical contact of claim 2, wherein the at least one washer engages a shoulder of the guide shaft.

5. The electrical contact of claim 1, further comprising a tubular seal having one end that is clamped to the open back end of the guide shaft.

6. The electrical contact of claim 5, wherein the tubular seal encloses the connection terminal and the back portion of the deformable conductor.

7. The electrical contact of claim 6, wherein the tubular seal encloses a portion of the supply cable.

8. The electrical contact of claim 5, wherein the tubular seal comprises an annular lip that is arranged between the retaining sleeve and a shoulder of the guide shaft.

9. The electrical contact of claim 8, wherein the coil spring is configured to exert axial pressure on the annular lip.

10. The electrical contact of claim 1, further comprising a toric seal arranged on the mobile contact head.

11. The electrical contact of claim 1, further comprising a toric seal arranged to provide sealing between the mobile contact head and the guide shaft.

12. The electrical contact of claim 1, wherein the deformable conductor comprises a braid.

13. The electrical contact of claim 12, wherein the braid is configured to deform by crushing.

14. The electrical contact of claim 1, wherein the retaining sleeve is retained in the guide shaft via at least one washer and wherein the at least one washer engages an intermediate member.

15. A connection system comprising:

a connection apparatus including a contact housing having an open front end and an opened back end;

a contact comprising a contact head, a coil spring, a retaining sleeve and a deformable conductor;

the contact head being arranged in an area of the open front end of the contact housing;

the deformable conductor having a front portion connected to the contact head and a flexible back portion that extends outside the contact housing;

a coil spring arranged in the contact housing and surrounding the front portion of the deformable conductor;

the coil spring extending between the contact head and the retaining sleeve;

the retaining sleeve being arranged in an area of the open back end of the contact housing;

the retaining sleeve being fixed to the deformable conductor; and the contact head being connected to a connection terminal of a supply cable outside of the contact housing via the flexible back portion of the deformable conductor.

16. The electrical contact of claim 15, wherein the retaining sleeve is retained in the contact housing via at least one washer.

17. The electrical contact of claim 16, wherein the at least one washer engages a shoulder of the contact housing.

18. The electrical contact of claim 15, further comprising a tubular seal having one end that is clamped to the open back end of the contact housing.

19. The electrical contact of claim 18, wherein the tubular seal encloses the connection terminal, the back portion of the deformable conductor and a portion of the supply cable.

20. The electrical contact of claim 19, wherein the tubular seal comprises an annular lip that is arranged between retaining sleeve and a shoulder of the contact housing.

21. The electrical contact of claim 15, further comprising a seal arranged to provide sealing between the contact head and the contact housing.

22. The electrical contact of claim 15, wherein the deformable conductor comprises a braid.

23. A connection system comprising:

a connection apparatus including a contact housing having an open front end and an open back end;

a contact comprising a contact head, a coil spring, a retaining sleeve and a braid conductor;

the contact head being arranged in an area of the open front end of the contact housing;

the braid conductor comprises a front portion coupled to the contact head and a flexible back portion that extends outside the contact housing;

a coil spring arranged in the contact housing and surrounding a portion of the braid conductor;

the coil spring extending between the contact head and the retaining sleeve;

the retaining sleeve being arranged in an area of the open back end of the contact housing;

the retaining sleeve being fixed to the braid conductor; and the flexible back portion of the braid conductor being connected to a connection terminal of a supply cable.

24. The electrical contact of claim 23, wherein the retaining sleeve is retained in the contact housing via at least one washer, wherein the at least one washer engages a shoulder of the contact housing and further comprising a tubular seal having one end that is clamped to the open back end of the contact housing.

* * * * *